United States Patent [19]

Willis

[11] Patent Number: 4,463,470

[45] Date of Patent: Aug. 7, 1984

[54] TOOTHBRUSH

[75] Inventor: Brian D. Willis, Edson, Canada

[73] Assignee: Brian D. Willis, P.C., Edson, Canada

[21] Appl. No.: 476,410

[22] Filed: Mar. 17, 1983

[51] Int. Cl.[3] ..... A46B 9/04

[52] U.S. Cl. ..... 15/167 R; D4/25

[58] Field of Search ..... 15/167 R, 167 A, 110, 15/143 R; D4/21-28

[56] References Cited

U.S. PATENT DOCUMENTS

| | | | |
|---|---|---|---|
| 1,901,866 | 3/1933 | Bryan | 15/167 R |
| 2,056,447 | 10/1936 | Fell | D4/2.5 X |
| 2,360,745 | 10/1944 | Vogel | 15/167 R |

FOREIGN PATENT DOCUMENTS

| | | | |
|---|---|---|---|
| 528868 | 11/1921 | France | 15/167 |
| 646729 | 7/1928 | France | 15/167 R |
| 715589 | 9/1931 | France | 15/167 R |

*Primary Examiner*—Peter Feldman

*Attorney, Agent, or Firm*—George A. Rolston

[57] ABSTRACT

A pair of complementary right and left-handed toothbrushes in which each brush has a handle, a brush head formed integrally with the handle portion, a first bend in such handle, formed in a transverse plane, so that the head is angled outwardly with respect to the handle, an axial twist in the handle between the bend and the head so that the head is rotated to lie in a plane displaced angularly outward, and a second bend in the handle between the twist and the head, lying in a plane transversely of the head. The said first bend, axial twist and second bend spatially orientate the brush head into the desired position relative to the handle.

1 Claim, 3 Drawing Figures

TOOTHBRUSH

BACKGROUND OF THE INVENTION

The conventional straight-handled toothbrush renders it difficult to apply the bristles in the correct orientation on all the teeth in both the upper and lower jaws on both sides of the mouth. In the past, various toothbrush handle designs have been proposed which incorporated some form of bend or angle, which was intended to give easier access to certain of the teeth. Usually however, these modifications resulted in making access to other teeth in other locations still more difficult than before.

One attempt to overcome the problem with accessibility has been to provide a knuckle joint, or swivel connection in the brush handle, so that the toothbrush head could be bent into various different angular positions relative to the handle. However, this is not a satisfactory solution to the problem, since in order to be effective the brush head would have to be locked firmly at the swivel joint and its position changed for each surface addressed. While a muscular person might find this relatively easy, a child or an elderly or handicapped person would find it impossible.

Even this type of brush handle with a hinge or joint did not provide the best access to teeth in all positions in both upper and lower jaws. Access to some teeth is facilitated by a bend in the handle in one plane, while access to other teeth is improved by an axial semi-rotation or twist.

These combined features were not available in the earlier toothbrush designs referred to.

BRIEF SUMMARY OF THE INVENTION

With a view to overcoming the foregoing disadvantages, the invention comprises a pair of complementary right and left-handed toothbrushes each brush having a handle portion defining front and rear surfaces, and inner and outer side edges, and a brush head portion formed integrally with said handle protion, and there being a bend formed in such handle, said bend being formed in a plane contained between the planes of said front and rear surfaces, whereby said head portion is angled outwardly with respect to said outer edge of said handle, and there being an axial twist portion in said handle between said bend portion and said head, whereby said head portion is rotated to lie in a plane displaced angularly outward and there being a further bend portion between the twist portion and the head whereby the axis of the head lies parallel to the axis of the handle.

More particularly, the invention provides a pair of such toothbrushes wherein both said bend portions and said twist portion are formed closely adjacent the head.

The various features of novelty which characterize the invention are pointed out with particularity in the claims annexed to and forming part of this disclosure. For a better understanding of the invention, its operating advantages and specific objects attained by its use, reference should be made to the accompanying drawings and descriptive matter in which there is illustrated and described a preferred embodiment of the invention.

DESCRIPTION OF A SPECIFIC EMBODIMENT

Figure 1:
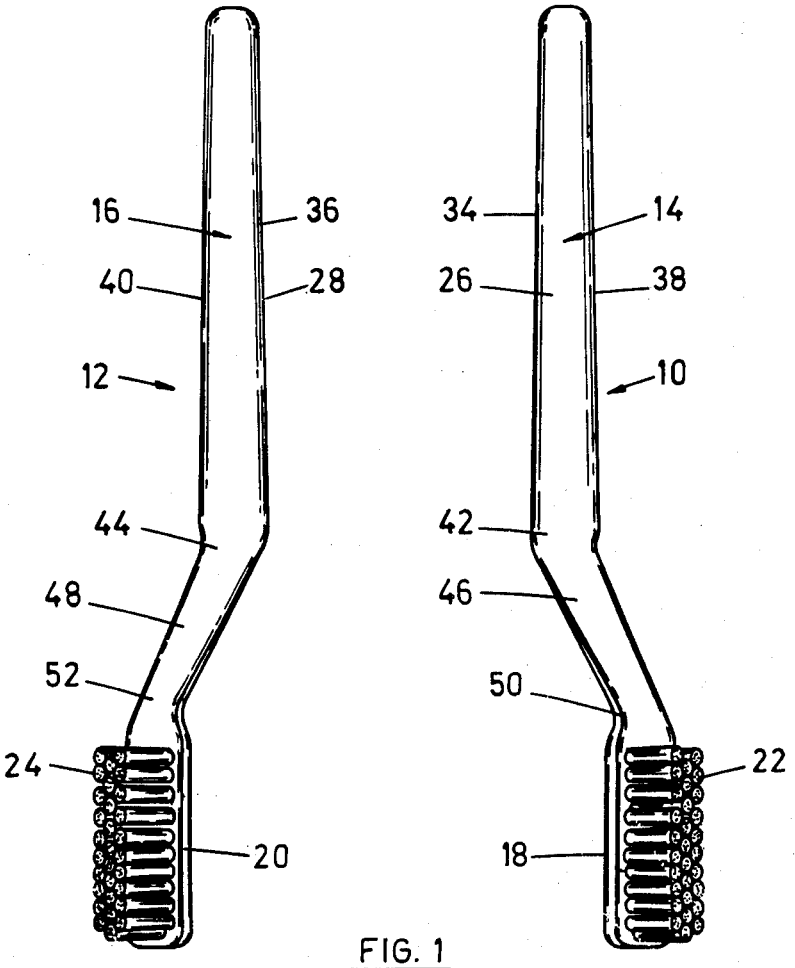
FIG. 1 is a perspective illustration of a pair of right and left-hand toothbrushes according to the invention.
Figure 2:
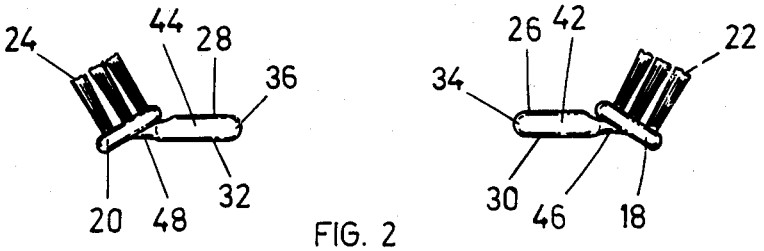
FIG. 2 is a section along the line 2—2 of FIG. 1.
Figure 3:
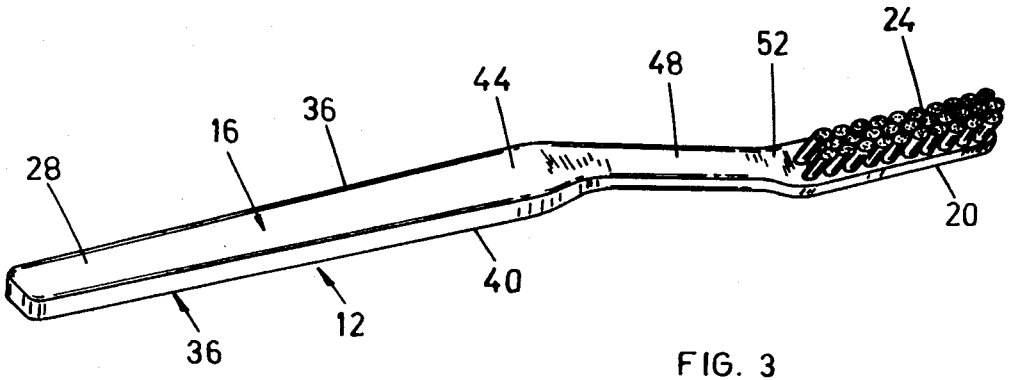
FIG. 3 is a section along the line 3—3 of FIG. 1.

The pair of toothbrushes according to the invention comprises a pair of complementary right and left hand brushes indicated generally as 10 and 12.

Each brush is of integral one piece construction, the one being right-handed and the other left-handed. Each brush will be seen to have a handle portion 14, 16, and a head portion 18, 20 provided with the usual bristles 22 and 24.

The design and shape of the head may vary and it may have a contoured or rounded end, and edges. In most such heads however, a section through the head will show a generally flattened shape defining a transverse plane which will extend through the widest portion of the head.

In each brush the head portion and handle portion are of integral one piece construction, typically being formed of a suitable thermoplastic material.

Each handle portion has a front face 26, 28 and a rear face 30, 32. Each handle portion has an inner side edge 34, 36 directed inwardly in opposition to one another, and have outer side edges 38, 40 which are directed outwardly opposite to the inner side edges.

The design and shape of such handles may vary widely and the faces and side edges may not always be precisely defined. In most handles however, a section through the handle will show a generally flattened shape defining a transverse plane which will extend through the widest portion of the handle.

Each handle portion has a first bend or angle 42, 44, which is formed in such transverse plane. Each handle portion further has a neck 46, 48, having an axial twist which angles the head portion outwardly, at an angle of about 45°.

In this way, each toothbrush of the pair provides a brush in which the handle is straight, and has a bend portion bending the head outwardly from the axis of the handle, and has a twist portion twisting the head outwardly from the plane of the handle.

Each of the brushes between the first bend portion and the head, has a second bend portion 50, 52, lying in the plane of the head portion, and bending the axis of the head back into parallelism with the axis of the handle.

In operation, the brush with the head angled and offset to the left will be used on the following tooth surfaces: left mandibular occlusal, left mandibular buccal, left maxillary palatal, right maxillary occlusal, right maxillary buccal, right mandibular lingual and the lower incisors, if the operator is right handed.

The brush with head angled and offset to the right, will be used on the following tooth surfaces: right mandibular occlusal, right mandibular buccal, right maxillary palatal, left maxillary occlusal, left maxillary buccal, left mandibular lingual and the upper incisors, if the operator is right handed.

A number of advantages flow from the invention.

1. A sequential brushing technique is encouraged. Therefore, there is increased brushing efficiency due to the fact that all surfaces are addressed.

2. The "parallel offset head" allows each surface to be addressed with the head of the brush parallel to the junction of the teeth and gums, and without the handle of the brush impinging on the incisor teeth or the lips.

3. Rotation of the parallel offset head enable the operator to apply the bristles directly onto the margins of the gums, a critical area in any cleaning technique. The increased efficiency achieved by advantages described in (2) and (3) should soon become evident with diminished plaque and improved gum health.

4. The conformity of the head relative to the handle will reduce that involuntary reflex known as gagging. This applies particularly to the lingual surface of the mandibular molar teeth, usually the most difficult surfaces to clean efficiently.

The foregoing is a description of a preferred embodiment for the invention which is given here by way of example only. The invention is not to be taken as limited to any of the specific features as described, but comprehends all such variations thereof as come within the scope of the appended claims. What is claimed is:

1. A pair of separate right and left handed toothbrushes wherein each brush comprises;

a handle portion defining front and rear surfaces, and inner and outer side edges, and a transverse plane and a free, unencumbered end;

a neck portion extending from the other end of said handle portion;

a brush head portion formed on said neck portion, and having a transverse plane;

a first bend formed between such handle and such neck, said first bend portion being formed in said transverse plane, whereby said neck portion is angled outwardly with respect to said outer edge of said handle;

an axial twist in said neck between said first bend portion and said head, whereby said head portion is rotated to lie in a plane disposed angularly outwardly;

a second bend between said neck portion and said head, said second bend lying in the transverse plane of said head, whereby the axis of said head is aligned parallel to the axis of said handle, and wherein said toothbrush is formed with said first bend angled to the right and said second bend to the left, and wherein the other said toothbrush is formed with the first bend angled to the left and the second bend to the right, and wherein said one toothbrush has an axial twist to the right, and wherein said other toothbrush has an axial twist to the left, whereby said one toothbrush may be used, in the right hand for cleaning the following surfaces: right mandibular occlusal, right mandibular buccal, right maxillary buccal, left mandibular lingual and the upper incisors, and whereby the other said toothbrush may be used in the right hand for cleaning the following tooth surfaces: left mandibular occlusal, left mandibular buccal, left maxillary palatal, right maxillary occlusal right maxillary buccal, right mandibular lingual and the lower incisors, said brushes being used separately and independently of one another.

* * * * *